United States Patent [19]

Kramer

[11] 4,441,529

[45] Apr. 10, 1984

[54] STABILIZED SHUTTLE GRIP

[75] Inventor: Charles F. Kramer, Greenville, S.C.

[73] Assignee: Steel Heddle Manufacturing Company, Greenville, S.C.

[21] Appl. No.: 445,356

[22] Filed: Nov. 29, 1982

[51] Int. Cl.[3] ..... D03J 5/16

[52] U.S. Cl. ..... 139/207

[58] Field of Search ..... 139/207, 206, 208

[56] References Cited

U.S. PATENT DOCUMENTS

| | | | |
|---|---|---|---|
| 3,048,197 | 8/1962 | Fink | 139/207 |
| 3,233,635 | 2/1966 | Klocker et al. | 139/207 |
| 4,298,032 | 11/1981 | Kaufmann et al. | 139/207 |

FOREIGN PATENT DOCUMENTS

| | | | |
|---|---|---|---|
| 2719475 | 8/1978 | Fed. Rep. of Germany | 139/207 |
| 2755207 | 6/1979 | Fed. Rep. of Germany | 139/207 |
| 381177 | 10/1964 | Switzerland | 139/207 |

*Primary Examiner*—James Kee Chi

*Attorney, Agent, or Firm*—Dority & Flint

[57] ABSTRACT

An encapsulated shuttle grip (B) is disclosed as including a molded housing (28) which co-operates with a shelf cut (C, C') in shuttle block (A) to interlock the shuttle grip positively and firmly in place. Compressible protrusions (58) carried on molded side wall ribs (54, 56) are compressed in lateral side cut grooves (66, 68) to resist rotation of gripping jaws (14, 16) about the axis of attachment bolt 38 during weaving and bobbin transfer along with other molded structural features of the molded housing 28.

11 Claims, 5 Drawing Figures

STABILIZED SHUTTLE GRIP

BACKGROUND OF THE INVENTION

The invention relates to a shuttle grip which holds a bobbin in a shuttle. Typically, the shuttle grip includes a pair of forked-shaped gripping jaws between which the butt of the bobbin is gripped with the thread of the bobbin being unwound from the spindle portion of the bobbin. The forked gripping jaws of the shuttle come together at a nose connecting portion. A bolt hole in the connecting portion is provided for physically attaching the shuttle grip to the shuttle. The gripping jaws of the shuttle which are the free ends of the shuttle grip extend freely into the opening of the shuttle for holding the bobbin.

During bobbin transfer, a depleted bobbin is removed and a full bobbin inserted by means of automatic filling equipment. This procedure, as well as the weaving operation, causes forces to be applied to the shuttle grip as attached to the shuttle. The forces tend to cause wear and loosening of the shuttle grip in the shuttle. Particularly this is true that forces which tend to rotate the shuttle grip vertically about the bolt axis during weaving and bobbin transfer.

In U.S. Pat. No. 4,298,032 an encapsulated shuttle grip is disclosed having as its purpose the imbedding of the shanks of the gripping jaws in a molded housing which extends around a portion of the shanks to space the gripping jaws accurately for positively gripping the butt end of the bobbin. Dimensional accuracy in the shuttle grip and completed shuttle assembly is thus enhanced.

SUMMARY OF THE INVENTION

Accordingly, an important object of the present invention is to provide a shuttle grip having features which enable it to be more firmly and positively held in the shuttle.

Another important object of the present invention is to provide an encapsulated shuttle grip which is more firmly united with a shuttle in a manner which resists rotation of the shuttle grip about its attachment to the shuttle.

Still another important object of the present invention is to provide a shuttle grip for holding a bobbin in a shuttle of the type having a pair of opposed spaced-apart gripping jaws imbedded in a molded housing having structural features which resist vertical and lateral rotation of the shuttle grip in the shuttle.

The above objectives are accomplished according to the present invention by providing an encapsulated shuttle grip in which the opposing gripping jaws of the shuttle grip are encapsulated in a molded housing. The molded housing includes a bottom rib which includes an arcuate extension that extends along at least a portion of the side walls of the molded housing for interlocking with a lateral shelf undercut in the shuttle side wall. The extended rib includes a compressible protrusion which is compressed between horizontal ledges of the shelf undercut to provide a tight fit and resist vertical rotational movements. The rib extends about the top and bottom of the nose portion of the molded housing in which end shank portions of the gripping jaws are molded together. A one-to-one fit between the walls of the shelf cut in the shuttle, the upper and lower ribs, and the side wall of the nose portion opposes lateral rotation of the shuttle grip in the shuttle. Clearance spaces are allowed between the shelf cut and the molded housing adjacent the gripping jaws to facilitate outward flexing of the gripping jaws during bobbin transfer. By this means, side-to-side as well as vertical rotation of the shuttle grip the shuttle is effectively restrained. Wear between the shuttle grip and shuttle and loosening of the shuttle grip in its attachment are reduced whereby the shuttle grip remains firmly and tightly attached in operation.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
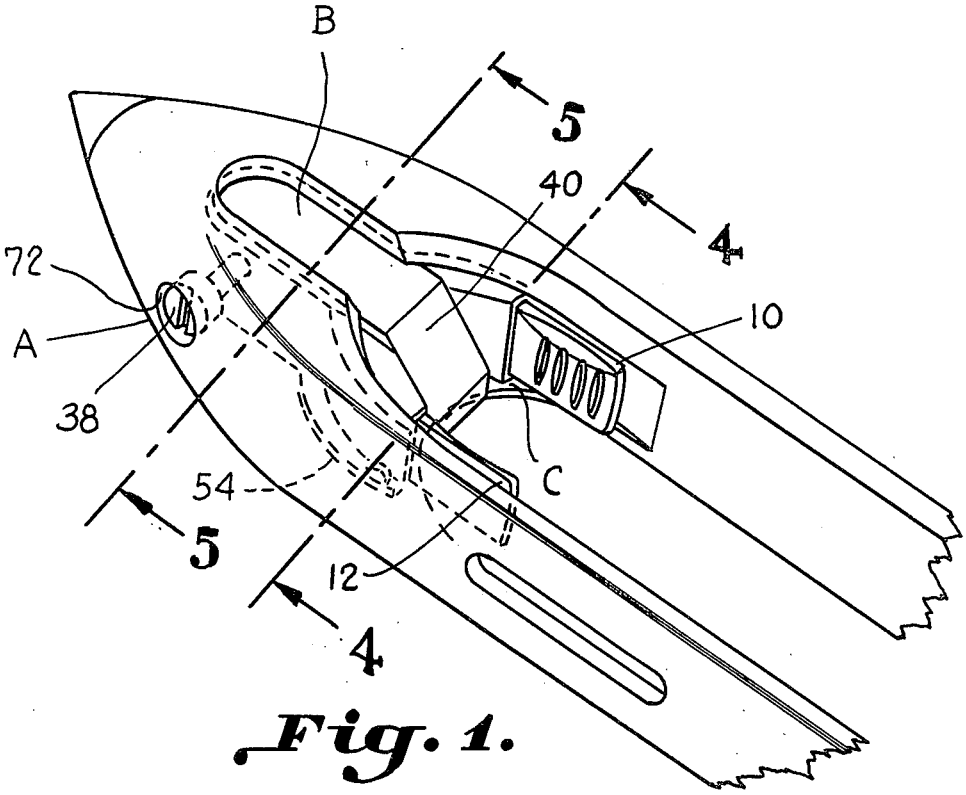
FIG. 1 is a perspective view of the forward end of a shuttle and a shuttle grip carried therein according to the invention.
Figure 2:
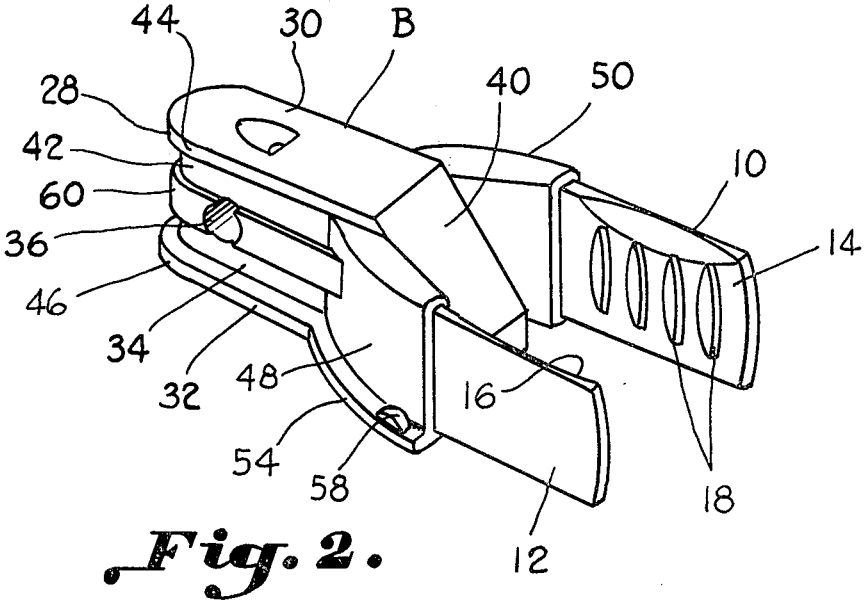
FIG. 2 is a perspective view of an encapsulated shuttle grip constructed according to the present invention.

Referring in more detail to the drawings, there is illustrated a shuttle A in which is attached a shuttle grip B having a pair of forked-shaped leaves 10 and 12 which are constructed of conventional steel. The leaves include gripping jaws 14 and 16 on the inner surfaces of the outer ends. Grooves 18 are provided on the inner surfaces of the gripping jaws 14 and 16 for receiving the rings normally provided on the butt end of a bobbin (not shown). The leaves 10 and 12 are bent inwardly as illustrated at intermediate curved portions 20 and 22 and terminate in end shank portions 24 and 26.

The shank portions are imbedded in a molded housing 28 and have substantially flat top and bottom surfaces 30 and 32. The housing is molded of any suitable material such as rubber, urethane, or plastic, which firmly holds the shank end portions. One suitable material is a 95D Durometer polyurethane. The molded housing includes a nose portion 34 which extends on both sides of the straight shank portions 24 and 26 of the leaves and extends in between the shank portions. Nose portion 34 includes a bolt hole 36 which serves to connect the grip and shuttle by means of bolt 38. The entire construction of the leaves 10 and 12 and shank end portions 24 and 26 may be made one-piece or may be made in two pieces, as shown in U.S. Pat. No. 4,298,032.

An inclined surface 40 acts as a guiding surface for the butt end of the bobbin as it is inserted between the jaws 14 and 16.

Exterior side wall 42 of the molded housing 28 is recessed between the bottom and top surfaces 30 and 32 of the housing to define top and bottom molded retaining ribs 44 and 46. Arcuate side walls 48 and 50 extend rearwardly from nose portion 34 and encase the intermediate curved portions 20 and 22 of the shuttle grip leaves. The arcuate extensions have a back side 48*a*, 50*a* between which an open space is provided on opposing sides of the inclined surface 40. As a result of the integral molded housing and casing, the intermediate and shank portions of the shuttle grip leaves, and the outer gripping jaws of the leaves are precisely positioned relative to each other.

Referring in more detail to the molded housing, it can be seen that the bottom surface 32 is defined by widened rib 46 which includes arcuate rib extensions 54 and 56 extending along at least a portion of the arcuate side wall portions 48 and 50, respectively, of the molded housing. A compressible rib means for being compressibly received in side undercut grooves of the shuttle block includes the side wall ribs and, in the illustrated embodiment, a compressible protrusion 58. Other forms of compressible ribs may also be utilized such as wedge-shaped ribs, etc. The compressible protrusion 58 is formed on the top surface of each rib extension 54, 56. The compressible protrusion of course, being made of the same yielding material as the remainder of the encapsulated housing, requires compression in order to be fitted within the shelf cut of the shuttle as will become more fully apparent.

A medial rib 60 is formed with the molded housing which has a generally rectangular cross-section defined by planar intersecting edges. The medial rib 60 serves to interlock the grip in the shelf cut of the shuttle.

Figure 4:
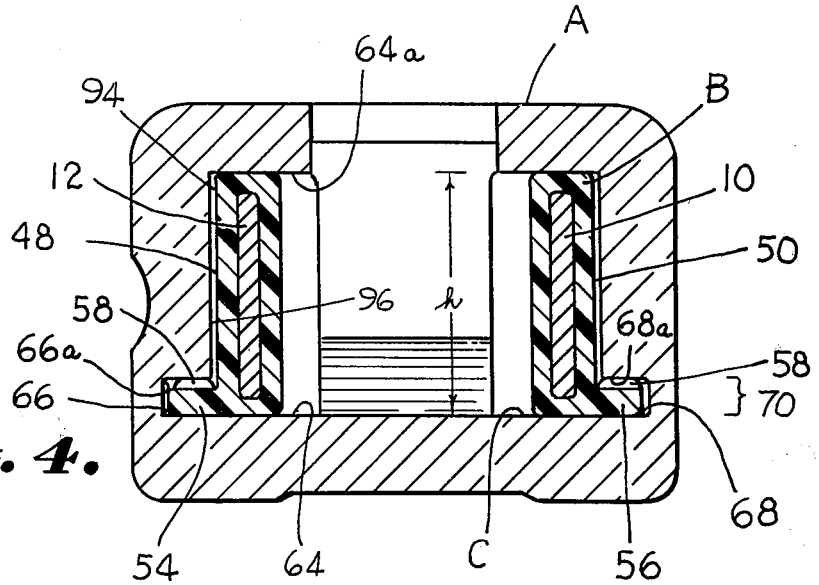
FIG. 4 is a sectional view taken along line 4—4 of FIG. 1.
Figure 3:
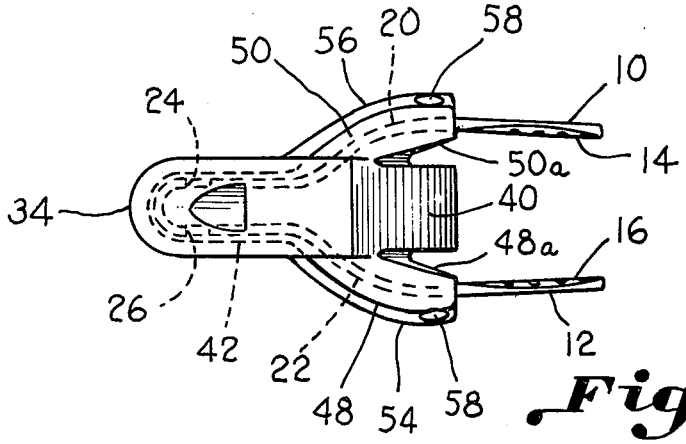
FIG. 3 is a top plan view of the shuttle grip of FIG. 3.

The shuttle A includes a shelf C cut into the shuttle block in which the shuttle grip is inserted and attached to the shuttle. Shelf C is cut out in the shuttle block for receiving the nose 34 and nose ribs 44, 46; and side walls 48, 50, and side wall rib extensions 54, 56 of molded housing 28, as can best be seen in FIGS. 4 and 5. The shelf C includes lateral grooves 66 and 68 which receive the side wall rib extensions 54 and 56, respectively. The grooves are defined by lateral undercuts made in the side walls of the shuttle block. For this reason, rib extensions 54 and 56 may extend along only a portion of side walls 48 and 50 to reduce the lateral extent of the cut-out in the shuttle block. It may be desirable to limit the ribs, for example, to half the distance, to avoid weakening of the shuttle side walls. A space 70 is defined between the floor surfaces 64 of the shelf cuts 68 and 66 and an upper shelf ledge 68*a* and 66*a*. This space 70 is dimensioned such that the compressible protrusion 50 is compressed when the grip is inserted in the shelf C.

The height between floor 64 of the shelf and an upper superposed ledge 64*a* is such that a one-to-one fit is provided between the tops and bottoms of side walls 48, 50 in the shelf cut C. This feature, together with the fitting of protrusions 58, assist in resisting rotation of the shuttle grip about the axis of attachment bolt 38 extending through opening 72 in the shuttle and 36 in the grip.

Figure 5:
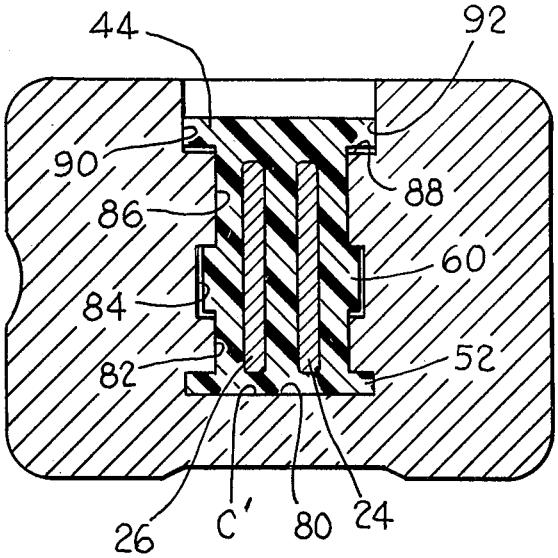
FIG. 5 is a sectional view taken along line 5—5 of FIG. 1.

The shelf cut C′ for nose portion 34, as can best be seen in FIG. 5, includes a lower cut-out ledge 80, narrowed lower wall portions 82, medial cut-out portions 84, narrowed upper wall portions 86, and upper ledge 88 and ledge walls 90. Lower wall 82 and upper walls 86 are dimensioned to provide generally a one-to-one fit with side wall 42 of nose 34 of the shuttle grip. By this means, side rotation of the shuttle grip is resisted. Likewise, a tight or one-to-one fit exists at 92 between upper ledge walls 90 and the sides of upper rib 44.

A gap 94 exists between the side walls 48, 50, and shelf walls 96 and between the sides of rib extensions 54 and 56 and between the vertical walls of shelf undercuts 66 and 68. This gap space facilitates outward movement of the gripping jaws during bobbin transfer.

It is noted that medial rib 60 of nose 34 has intersecting planar sides which interlock with medial groove 84 having a corresponding cross-section. These features further resist vertical rotation of the shuttle grip about the attachment bolt axis.

An advantageous construction for an encapsulated shuttle grip can be had according to the invention in which the structural features of an encapsulating molded housing interlock with the shelf cut in the shuttle block to resist lateral and vertical rotations of the grip in the block during weaving and bobbin transfer. The molded housing is preferably formed of a yielding material having compressible features which enable compressible interlocking of grip in the shuttle block.

While a preferred embodiment of the invention has been described using specific terms, such description is for illustrative purposes only, and it is to be understood that changes and variations may be made without departing from the spirit or scope of the following claims.

What is claimed is:

1. An encapsulated shuttle grip for use in a shuttle for holding a bobbin in a properly aligned position during weaving, said shuttle having a shelf cut formed therein in which said shuttle grip is received for attachment to said shuttle by means of an attachment bolt, said shelf cut having a side under cut groove formed in a side wall of said shuttle, said shuttle grip comprising:

a pair of opposed rigid leaves having spaced apart gripping jaws, end shank portions, and intermediate curved portions joining said gripping jaws and shank portions;

a molded housing having a forward nose portion;

said end shank portions being encapsulated in said nose portion of said molded housing with said gripping jaws extending outwardly from said molded housing being free from said molded housing; and said molded housing including arcuately extended side walls encapsulating at least a portion of said intermediate curved portions of said shuttle grip leaves;

a molded bottom rib extending outwardly from said arcuately extended side walls along at least a portion of said side walls rearwardly from said nose portion; and said bottom rib being receivable in said side undercut groove of said shelf of said shuttle for interlocking engagement therein resisting rotational movement of said shuttle grip about said attachment bolt.

2. The device of claim 1 including a compressible protrusion formed on an upper surface of said bottom rib which is squeeze-fitted between upper and lower surfaces of said side undercut groove when said rib is received therein.

3. The device of claim 1 wherein said molded housing includes spaced horizontal surfaces having a vertical height dimension providing a one-to-one fit with surfaces of said shelf cut of said shuttle.

4. The device of claim 3 wherein top and bottom surfaces of said nose portion provide said fit with said shelf cut.

5. The device of claim 3 wherein top and bottom surfaces of said arcuate side walls provide said fit with said shelf cut.

6. The device of claim 1 including a medial rib molded around said nose portion having a cross-section defined by intersecting edges which interlock with said shelf cut to resist rotation about said attachment bolt.

7. The device of claim 1 including a top rib molded in a top portion of said nose portion, said top rib and bottom rib having width dimensions across said top and bottom surfaces of said nose portion providing a generally one-to-one fit with vertical side walls of said shelf cut structure to resist lateral rotation of said shuttle grip in said shuttle.

8. The device of claim 1 including a gap defined between said arcuately extended side walls of said molded housing and vertical walls of said shelf cut, and a gap between sides of said bottom rib and said shelf cut accommodating outward movement of said shuttle grip leaves facilitating transfer of said bobbin in and out of said shuttle.

9. An encapsulated shuttle grip for use in a shuttle having a shelf cut formed therein structure in which said shuttle grip is inserted and attached for holding a bobbin in a properly aligned position in said shuttle for weaving, said shuttle grip comprising:

a pair of opposed rigid leaves having spaced apart gripping jaws, end shank portions, and intermediate curved portions joining said gripping jaws and said end shank portions;

a molded housing having a forward nose portion;

said molded housing having arcuate side walls extending rearwardly from said nose portion encapsulating at least a portion of said intermediate curved portions of said shuttle grip leaves;

said end shank portions being encapsulated in said nose portion of said molded housing with said gripping jaws extending outwardly from said molded housing being free for receiving a butt end of said bobbin;

a recessed side wall molded in said nose portion;

a top nose rib molded in a top surface of said nose portion extending outwardly from said recessed side wall;

a bottom nose rib molded in a bottom surface of said nose portion;

arcuate side wall ribs extending along said curved side wall portions of said molded housing extending outwardly from said side walls; and a medial rib molded about said nose portion having planar sides and intersecting edges.

10. The device of claim 9 including a compressible protrusion carried by said arcuate side wall rib.

11. An encapsulated shuttle grip for use in a shuttle for holding a bobbin in a properly aligned position during weaving, said shuttle having a shelf cut formed therein in which said shuttle grip is received for attachment to said shuttle by means of an attachment bolt, said shelf cut having a side under cut groove formed in a side wall of said shuttle, said shuttle grip being of the type including a pair of opposed rigid leaves having spaced apart gripping jaws, end shank portions, and intermediate curved portions joining said gripping jaws and shank portions, a molded housing having a forward nose portion, said end shank portions being encapsulated in said nose portion of said molded housing with said gripping jaws extending outwardly from said molded housing being free from said molded housing, said molded housing including arcuately extended side walls encapsulating at least a portion of said intermediate curved portions of said shuttle grip leaves, wherein said encapsulated shuttle grip comprises:

compressible rib means including a molded bottom rib extending outwardly from said arcuately extended side walls along at least a portion of said side walls; and said compressible rib means being compressed in said side undercut groove maintaining said shuttle grip firmly and positively in said shuttle against rotation.

* * * * *